United States Patent [19]

Christie

[11] 4,199,122

[45] Apr. 22, 1980

[54] SUPPORT RACK FOR POLYETHYLENE BAG

[76] Inventor: Eugene P. Christie, 555 Edgemont La., Park Ridge, Ill. 60068

[21] Appl. No.: 923,098

[22] Filed: Jul. 10, 1978

[51] Int. Cl.[2] ..... A63B 55/04

[52] U.S. Cl. ..... 248/97; 312/211

[58] Field of Search ..... 248/95, 97, 99, 100, 248/101; 232/43.2; 312/211; 220/65

[56] References Cited

U.S. PATENT DOCUMENTS

| | | | |
|---|---|---|---|
| 447,686 | 3/1891 | Holladay | 248/97 |
| 1,005,956 | 10/1911 | Gibbins | 248/97 |
| 1,250,316 | 12/1917 | Johnson | 248/97 X |
| 2,314,490 | 3/1943 | Goldman | 248/97 X |
| 2,701,883 | 2/1955 | Fazio | 248/95 X |
| 3,556,395 | 1/1971 | Herman | 312/211 X |
| 3,773,286 | 11/1973 | Govoni | 248/150 X |

FOREIGN PATENT DOCUMENTS

| | | | |
|---|---|---|---|
| 598057 | 11/1977 | Switzerland | 248/97 |
| 1049490 | 11/1966 | United Kingdom | 248/99 |

*Primary Examiner*—J. Franklin Foss

*Attorney, Agent, or Firm*—Trexler, Wolters, Bushnell & Fosse, Ltd.

[57] ABSTRACT

A support rack adapted for suspending a flexible plastic bag having diametrically opposed handles in an open condition while simultaneously buttressing the bag to facilitate the loading of articles therein comprises a skeletal, open frame including back support means and confronting side support means for receiving a bag to be supported. The back and side support means are arranged to define a confinement boundary for the back and side panels of the bag and have dimensions generally corresponding to the height and width dimensions of the bag when opened. The rack further comprises bag suspending means carried by each side support means arranged to receive the bag handles for maintaining the bag in a suspended, opened condition. A rack mounting means projects rearwardly from the back support means and has pendant coupling means for mounting the rack along the top edge of a horizontally disposed support member.

3 Claims, 3 Drawing Figures

SUPPORT RACK FOR POLYETHYLENE BAG

BACKGROUND OF THE INVENTION

The present invention is directed to a support rack which is adapted for suspending a flexible plastic bag in an opened condition while simultaneously buttressing the bag to facilitate the loading of articles therein.

The use of flexible plastic bags in retail supermarkets for packaging merchandise, such as groceries, is becoming more prevalent. Because such bags are flexible by nature, some means must be provided for suspending the flexible bags in an opened condition while simultaneously buttressing the bags to facilitate the loading of articles therein.

To that end, many forms of supports for flexible bags have been devised. One such apparatus for supporting a flexible bag is described, for example, in U.S. Pat. No. 4,062,170. Unfortunately, supports for flexible bags of this type have not been totally successful. For example, the apparatus described in the aforementioned patent includes side and bottom walls which are formed from solid sheet metal resulting in a rather heavy structure. Furthermore, the apparatus described in the aforementioned patent does not include handles or other similar structure. Both the excessive weight and lack of handles detracts from the portability of the apparatus. Portability of such an apparatus is extremely necessary in a retail supermarket environment wherein the bag supports must be moved from one checkout counter to another in order to accommodate varying bagging work load conditions.

Furthermore, bag support structures of the prior art have generally required specially designed accompanying apparatus for holding the bag supports during use. This also encumbers the use of such devices in an environment in which flexibility is a very important factor.

It is therefore a general object of the present invention to provide a new and improved support apparatus which is adapted to maintain a flexible bag in an open condition while simultaneously buttressing the bag to facilitate the loading of articles therein.

It is a further object of the present invention to provide a flexible bag support apparatus which takes the form of a rack comprising a skeletal, open frame having a plurality of horizontal and vertical rod members joined together to form a back support and confronting side supports for receiving a flexible bag to thereby minimize the weight of the bag support.

It is a still further object of the present invention to provide a support rack adapted for suspending a plastic bag in an open condition while simultaneously buttressing the bag to facilitate the loading of articles therein, wherein the support rack includes a bag holding means by which flexible bags to be supported may be conveniently and securely held by the rack in a ready condition for use.

It is a still further object of the present invention to provide a support rack for flexible plastic bags which includes a bag suspending means for suspending the bags in an open condition and which also provides handles for the rack to render the rack conveniently portable.

SUMMARY OF THE INVENTION

The present invention provides a support rack for flexible bags having an upper, struck-out portion forming diametrically opposed handles, wherein the rack is adapted for suspending a plastic bag in an open condition while simultaneously buttressing the bag to facilitate the loading of articles therein. The support rack comprises a skeletal, open frame, including back support means and confronting side support means for receiving a bag to be supported. The back and side support means are arranged to define a confinement boundary for the back and side panels of the bag and have dimensions generally corresponding to the height and width dimensions of the bag when opened. The support rack further comprises bag suspending means carried by each side support means arranged to receive the bag handles for maintaining the bag in a suspended, opened condition. The support rack further comprises rack mounting means projecting rearwardly from the back support means and having pendant coupling means for mounting the rack along the top edge of a horizontally disposed support member.

BRIEF DESCRIPTION OF THE DRAWINGS

The features of the present invention which are believed to be novel are set forth with particularity in the appended claims. The invention, together with further objects and advantages thereof, may best be understood with reference to the following description taken in conjunction with the accompanying drawings, in the several figures of which like reference numerals identify like elements, and in which:

DESCRIPTION OF THE PREFERRED EMBODIMENT

Figure 1:
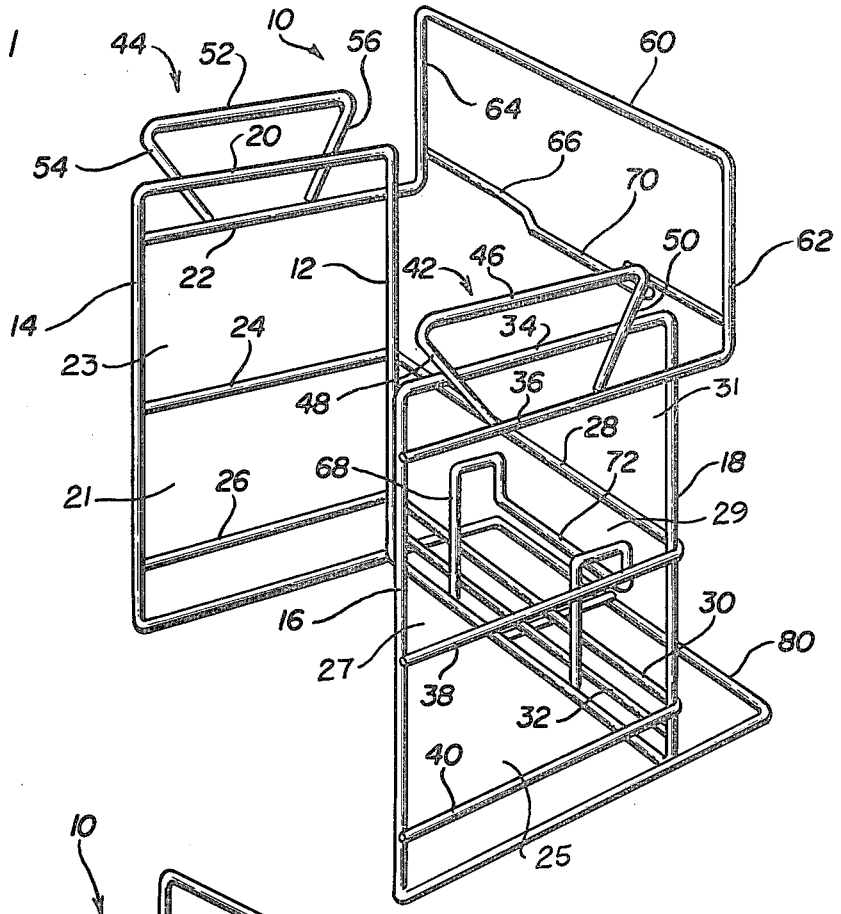
FIG. 1 is a perspective view of a support rack embodying the present invention.

Referring now to FIG. 1, the support rack there illustrated is particularly adapted for use in conjunction with flexible plastic bags of the type described and claimed in U.S. Pat No. 3,774,838 which issued Nov. 27, 1973 in the name of the inventor of the present invention. The plastic bag construction there disclosed includes front and back panels and diametrically opposed side panels having folded in portions when the bag is closed. The bag also includes an upper struck-out portion in the front and back panels. The struck-out portion is of sufficient width to engage the folded in portions to form diametrically opposed handles for the bag. For a complete description of this bag construction, reference may be had to the aforementioned patent which is incorporated herein by reference.

Figure 2:
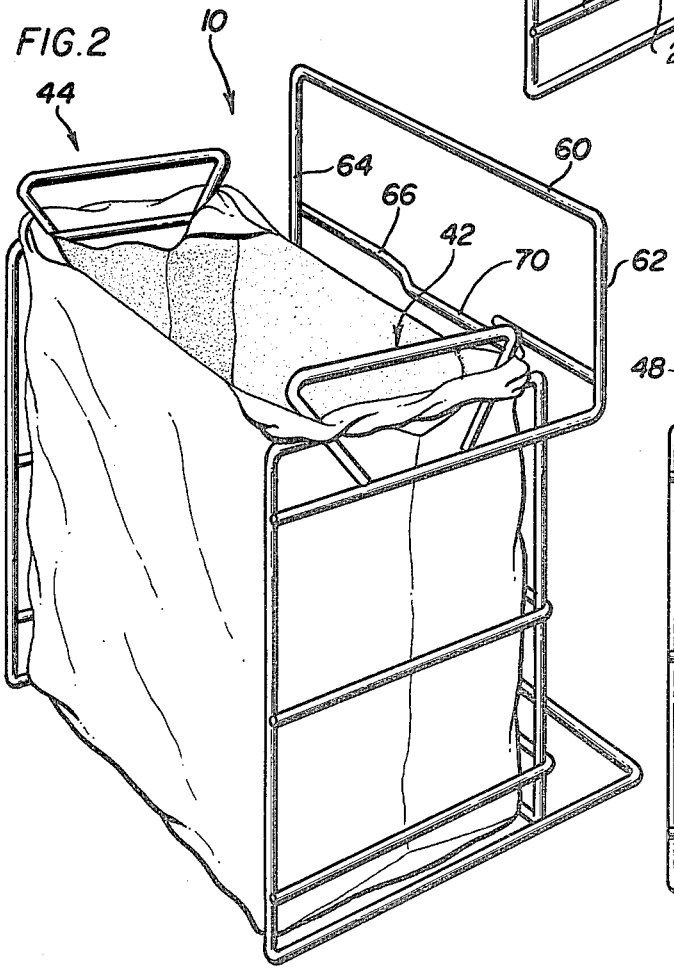
FIG. 2 is a perspectiv view of the support rack of FIG. 1 shown supporting a plastic bag in an open condition for use thereof.

The support rack 10 of FIG. 1 comprises a skeletal, open frame which includes a plurality of vertical rod members 12, 14, 16 and 18 and a plurality of horizontal rod members 20, 22, 24, 26, 28, 30, 32, 34, 36, 38 and 40 which are joined together, as shown, to provide a back support and confronting side supports for receiving a bag to be supported as shown in FIG. 2. The back and confronting side supports are arranged to define a confinement boundary for the back and side panels of the bag and, as best seen in FIG. 2, have dimensions generally corresponding to the height and width dimensions of the bag when opened. Due to the skeletal structure of the frame, a plurality of open windows 21, 23, 25, 27, 29 and 31 are thus formed in the confronting side and back supports.

For suspending a bag in an opened condition, each side support of the rack includes a bag suspending means which take the form of rod members 42 and 44. Each of the rod members 42 and 44 are bent into a substantially U-shaped configuration and are inverted and secured to respective horizontal rod members 34 and 20. To that end, rod member 42 has a horizontal portion 46 which is substantially parallel to and spaced above rod member 34 and has side portions 48 and 50 which converge in a downward direction. As can be seen from the drawings, rod member 42 is secured to the rack at the junction of side portions 48, 50 and the horizontal rod member 34 as by welding.

Similarly, rod member 44 has a horizontal portion 52 which is substantially parallel to and spaced above rod member 20. Rod member 44 also has a substantially U-shaped configuration with side portions 54 and 56 converging in a downward direction. The rod member 44 is secured to the horizontal rod member 20 at the junction of rod member 20 with the side portions 54 and 56.

Figure 3:
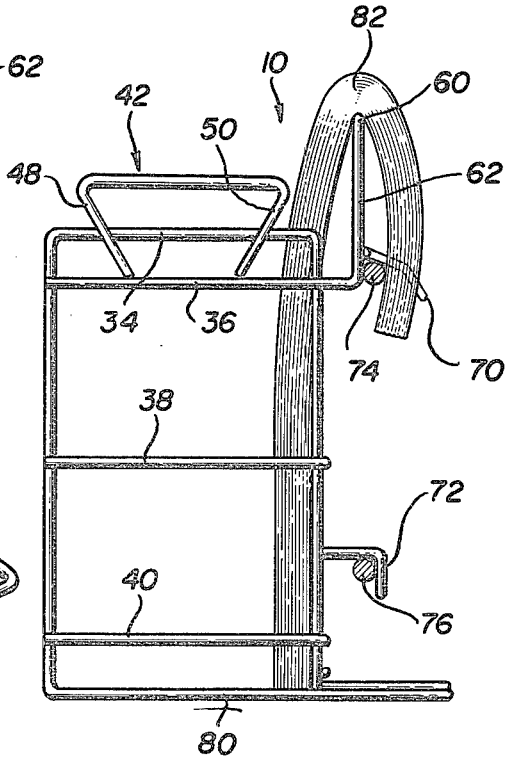
FIG. 3 is a side view of the support rack of FIG. 1 illustrating the manner in which the support rack may be mounted to a pair of vertically spaced and horizontally disposed support rails and illustrating the manner in which plastic bags to be supported may be conveniently and securely held in a ready condition for use.

Another horizontal rod member 60 integral with horizontal rod members 36 and 22 extends across the side supports and is arranged by vertical rod extensions 62 and 64 to be vertically spaced above horizontal rod members 20 and 34, and thus, to be arranged vertically spaced above a support bag. The horizontal rod member 60 thereby forms a bag holder across which one or more bags to be supported may be draped as best seen in FIG. 3.

The support rack of FIG. 1 is also adapted to be conveniently mounted along the top edge of a horizontally disposed support member or, to be mounted onto a pair of vertically spaced horizontaly disposed support rails. To that end, the support rack includes a rack mounting means comprising rod member 66 which is secured to vertical extensions 62 and 64, and rod member 68 which is secured to horizontal rod members 30 and 32. The rod members 66 and 68 have substantially U-shaped portions 70 and 72 which are extended rearwardly of the rack and which comprise pendant portions. These pendant portions adapt the support rack 10 for mounting to a horizontally disposed support member or a pair of vertically spaced horizontally disposed support rails 74 and 76 as shown in FIG. 3.

The substantially U-shaped portion 70 of rod member 66 has a width dimension corresponding to the width dimension of the struck-out portion of the bags. Because the U-shaped portion 70 is inclined downwardly, it forms a hook-like structure which is insertable through the struck-out portions of the bags to securely hold the bags in ready condition for use. Additionally, the substantial width dimensions of the U-shaped portions 70 and 72 provide for the stable mounting of the rack.

The rack 10 also includes a base 80 which is greater in dimension than the side and back dimensions of the rack so that the rack may be placed on a horizontal surface in a stable condition. The greater dimension of the base assures that the rack will not tip over when placed onto such a horizontal surface for use.

Referring now to FIG. 2, it illustrates the support rack of the present invention in use. As can be seen from the figure, the rod members 42 and 44 receive the diametrically opposed handles of the bag. The configuration of the rod members 42 and 44 assure that the bag will be securely held suspended in place in an open condition. Furthermore, the rod members 42 and 44 provide handles for the rack to adapt the support rack for convenient portability. Also, as can be seen from the figure, the frame-like structure of the rack provides a sufficient confinement boundary for the plastic bag to buttress the bag to an extent whereby it will maintain its shape as articles are loaded therein. Also, because of the frame-like structure of the support rack of the present invention, the rack is of substantially reduced weight, which further lends to its portability and convenience in use.

Referring to FIG. 3, it shows the support rack 10 holding a plurality of flexible plastic bags 82 in condition for ready use. The plastic bags 82 are draped over the horizontal rod member 60 with their struck-out portions received by the pendant portion 70. As a result, dependent portion 70 serves a double purpose. The pendant portion 70 not only allows for convenient mounting of the rack to horizontally disposed support member, such as rail 74, but also, provides a hook-like structure to securely hold the bags in place for ready use.

The invention therefore provides a new and improved support rack for flexible plastic bags. Because the support rack of the present invention comprises a skeletal, open frame construction, it is much lighter than prior art flexible bag supports which lends greatly to its portability. Additionally, the bag suspending structure of the rack of the present invention not only serves to suspend the bag in an open condition but also forms handles by which the rack may be easily carried and transported from one bagging position to another. Furthermore, the support rack of the instant invention includes means for holding the bags to be suspended in a ready condition while also providing a means for securely holding the bags to be suspended in a ready condition for use. As a result, the support rack of the present invention exhibits advantages over prior art structures adapted to support plastic bags, in that, it is lighter in weight, more readily portable, and, more convenient in use.

While a particular embodiment of the present invention has been shown and described, modifications may be made, and it is intended to cover in the appended claims all such changes and modifications which fall within the true spirit and scope of the invention.

The invention is claimed as follows:

1. A support rack for flexible plastic bags having an upper, struck out portion forming diametrically opposed handles, said rack being adapted for suspending a plastic bag in open condition while simultaneously buttressing the bag to facilitate the loading of articles therein, said support rack comprising: a skeletal, open frame including back support means and confronting side support means for receiving a bag to be supported, said back and side support means being arranged to define a confinement boundary for the back and side panels of the bag and having dimensions generally corresponding to the height and width dimensions of the bag when opened, said support rack further comprising bag suspending means carried by each said side support means arranged to receive the bag handles for maintaining the bag in a suspended, opened condition, said bag suspending means comprises an inverted substantially U-shaped rod member affixed to a respective one of said side support means, each said inverted U-shaped rod member having a horizontal portion substantially parallel to and spaced above its respective side support means and side portions converging in a downward direction for securely receiving the bag handles and for providing the rack with handles for adapting the rack for convenient portability, and rack mounting means projecting rearwardly from said back support means and having pendant coupling means for mounting said rack along the top edge of a horizontally disposed support member.

2. A support rack as defined in claim 1 further comprising a horizontal rod member secured to and extending across said side support means, and arranged to be vertically spaced above a supported bag to provide a bag holder across which one or more bags to be supported may be draped.

3. A support rack for flexible plastic bags having folded in side panel portions when closed and an upper struck out portion in the front and back panels of sufficient width to engage the folded in portions to form diametrically opposed handles, said support rack being adapted for suspending a plastic bag in an open condition while simultaneously buttressing the bag to facilitate the loading of articles therein comprising: a skeletal, open frame including a plurality of horizontal and vertical rod members forming back support means and confronting side support means for receiving a bag to be supported, said back and side support means being arranged to define a confinement boundary for the back and side panels of the bag and having dimensions generally corresponding to the height and width dimensions of the bag when opened, said support rack further comprising a bag suspending means affixed to each respective side support means each said bag suspending means including an inverted substantially U-shaped rod member having a horizontal portion substantially parallel to and spaced above its respective side support and having side portions converging in a downward direction for securely receiving the bag handles and maintains the bag in a suspended, opened condition, and providing the rack with handles for facilitating convenient portability of said rack, bag holding means comprising a horizontal rod member secured to and extending across said side support means arranged to be vertically spaced above a supported bag, to provide a bag holder across which one or more bags may be draped, and rack mounting means projecting rearwardly from said back support and having pendant portion of substantial horizontal width generally corresponding to the width of the bag struck out portion for providing convenient and stable mounting of said rack along the top edge of a horizontally disposed support member and, for providing a hook-like extension insertable through the struck out portions of the draped bags for securely holding the bags to be supported in a ready condition for use.

* * * * *